United States Patent [19]

Richards et al.

[11] 4,106,396

[45] Aug. 15, 1978

[54] APPARATUS FOR FORMING A CONTAINER HAVING A ROLLED RIM

[75] Inventors: Frank P. Richards, Prairie Village, Kans.; Jerry W. Young, Weston, Mo.

[73] Assignee: Phillips Petroleum Company, Bartlesville, Okla.

[21] Appl. No.: 798,217

[22] Filed: May 18, 1977

[51] Int. Cl.[2] ..... B31B 17/02

[52] U.S. Cl. ..... 93/36.5 R; 93/44.1 R

[58] Field of Search ..... 93/39 C, 39.2, 39.3, 93/36.5 R, 44.1 R

[56] References Cited

U.S. PATENT DOCUMENTS

| | | | |
|---|---|---|---|
| 2,703,514 | 3/1955 | Thiem | 93/36.5 R X |
| 3,065,677 | 11/1962 | Loeser | 93/36.5 R |

*Primary Examiner*—Roy Lake
*Assistant Examiner*—Paul A. Bell

[57] ABSTRACT

An apparatus is provided for forming a container having a rolled rim on the free end thereof. The apparatus includes means for forming a container blank having a bottom member secured in one end thereof wherein the formed container blank is suitably transferred to rim forming means wherein a rolled rim or bead is formed on the free end thereof by the forming means. The container blank forming means includes a bottom forming means and means for feeding side walls in a heated condition to the forming means. Also provided is means for wrapping a side wall blank to form the container blank side wall and means for securing the bottom member to the side wall. The means for forming the rim on the container blank includes a forming head which cooperates with a ring movably mounted on a container receiving receptacle to form the rolled rim on the container blank.

13 Claims, 7 Drawing Figures

APPARATUS FOR FORMING A CONTAINER HAVING A ROLLED RIM

In the manufacture of paperboard containers or other types of containers, a rolled rim is normally formed on the open end thereof to provide rigidity and thereby increase the strength of the open end of the container. Also, a rolled rim or bead eliminates a possible sharp edge on the end of the container. Also, the rolled rim provides good sealing engagement with the lid placed on the container.

There are numerous apparatuses used in the art for forming the rolled rim on a container and accomplish the formation of the rolled rim with varying degrees of success. Two of the major faults with such apparatus is the non-uniformity of rolled rim formed and the complicated apparatus necessary to form such a rolled rim. The first problem, that which involves the non-uniformity of the rolled rim, exemplifies itself in the visual appearance, i.e., wrinkles, bulges, etc. of the rolled rim or bead, and also the incomplete rolling of the rim so as to form a uniform rim from container to container. Typical complicated apparatus for forming rolled rims are disclosed in U.S. Pat. Nos. 2,272,920 and 2,778,287. The present invention provides a simplified apparatus for forming a rolled rim on a container blank which forms an improved quality rolled rim with a higher degree of consistency. This is accomplished by using in combination a rotating forming head and a movable ring mounted on the receptacle which cooperate to form the bead or rim forming groove with the ring being movable by cooperative engagement with a portion of the forming head.

The principal objects and advantages of the present invention are: to provide a simple apparatus for forming a rolled rim on an end of a container blank; to provide such an apparatus which will consistently form high quality rolled rims; to provide such an apparatus which requires a minimum of time to form a rolled rim so as to maintain adequate levels of output rates; to provide such an apparatus which is simple in operation and construction requiring a minimum of maintenance and which is inexpensive to construct; and to provide such an apparatus which is well adapted for its intended use.

Other objects and advantages of the present invention will become apparent from the following detailed description taken in connection with the accompanying drawings wherein are set forth by way of illustration and example certain embodiments of the present invention.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed are not to be interpreted as limiting, but merely as a basis for the claims and as a representative basis for teaching one skilled in the art to variously employ the present invention in virtually any appropriate structure.

Figure 1:
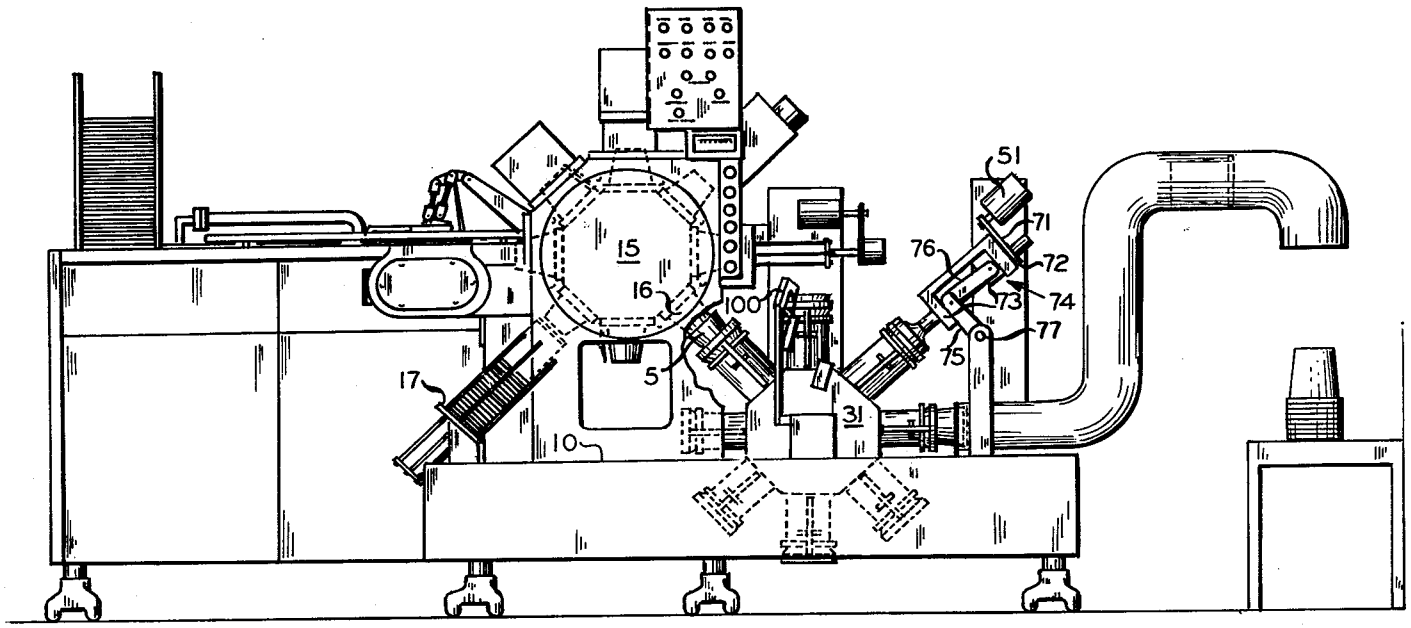
FIG. 1 is a side-elevational view of an apparatus used for forming containers.
Figure 2:
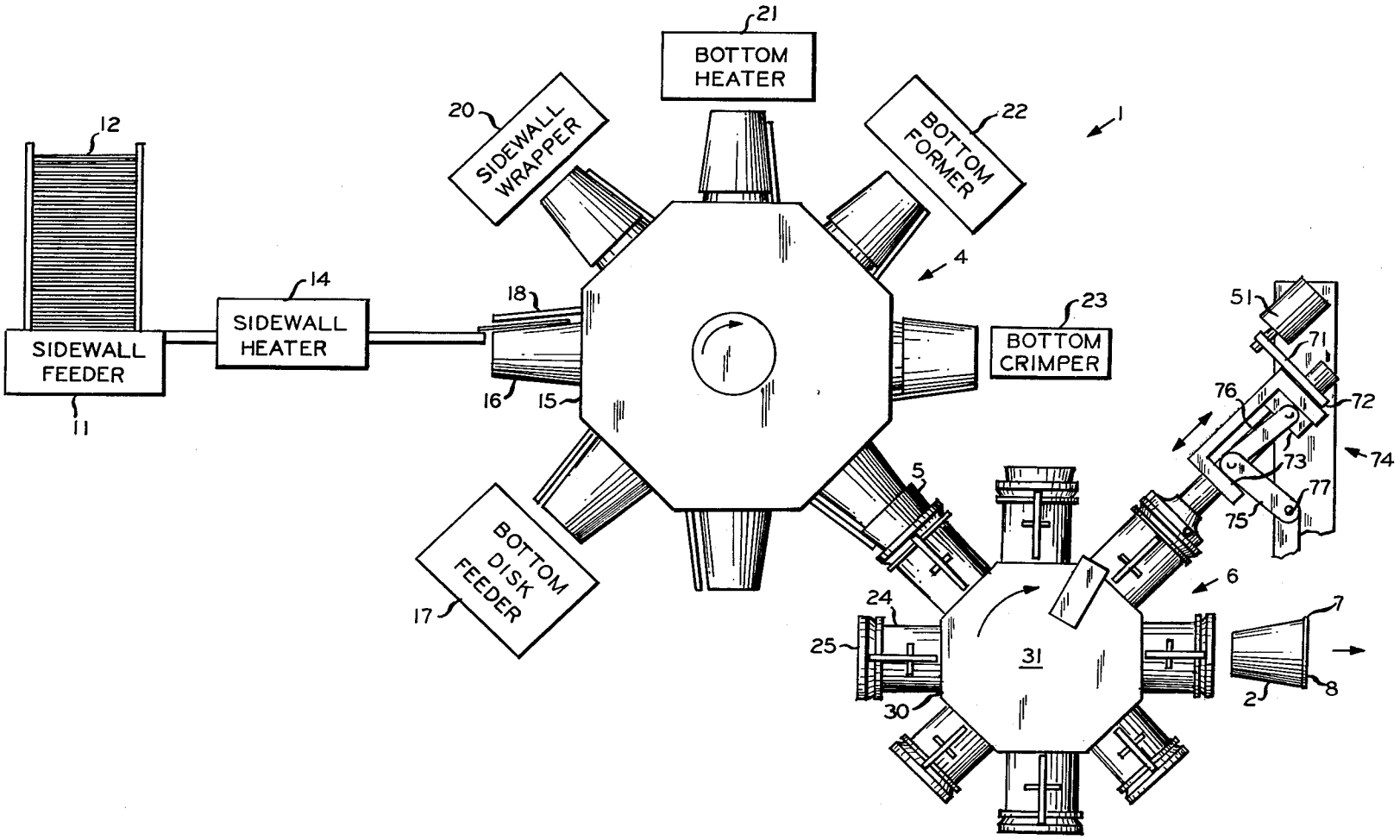
FIG. 2 is a schematic illustration of the apparatus of FIG. 1.

Referring to FIGS. 1 and 2, the reference numeral 1 designates generally an apparatus for forming a container 2. The apparatus 1, as illustrated, is adapted for making paperboard containers and includes means for forming a container blank from a side wall and bottom member with the means 4 being known in the art. The container blank 5 is transferred to means 6 which is operable to form a rolled rim or bead 7 on a free end 8 on the end of the container blank 5 to form a finished container 2.

The means 4 can be of any suitable type as is known in the art and as shown includes a side wall feeder 11 which is adapted to feed side wall blanks 12 to a side wall heater 14 which heats the side wall blanks to a predetermined temperature after which same are fed to a conveying turret 15 which has a plurality of mandrels 16 secured thereto. Drive means (not shown) are operably connected to the turret 15 for sequentially moving same between various circumferential positions moving the mandrel 16 to various means for forming containers from the side wall blanks 12. A bottom member feeder means 17 is carried by the support 10 and can be similar to the bottom feed means as are known in the art which are operable to form a bottom member and insert same into the mandrel 16 for further operation. A side wall blank is then positioned on the mandrel 16 and is held in place by a clamp arm 18 after which the side wall blank and mandrel are moved to a side wall wrapping means 20 such as those known in the art. The side wall wrapper is operable to wrap the side wall blanks around the mandrel and secure overlapping edges to form the container's side wall. After this forming operation, the formed side wall and respective mandrel is moved to bottom heating means 21 which is operable to heat the bottom member and edge portion of the formed sidewall before the bottom is formed by bottom forming means 22 with the heating means and forming means being of a type such as that known in the art. After the heating step, the formed sidewall is moved to the bottom forming means 22 folds a portion of the bottom of the container side wall to overlap same with a skirt portion of the bottom member to secure same together. The completed container blank 5 is then moved to the bottom crimper means where the folds made by bottom former means 22 are compressed by fluted rollers, container blank 5 is then further indexed to a position so that same can be transferred to bead forming means 6. Apparatuses and methods for conducting the formation of the container blank 5 are known in the art and are therefore not described in detail herein but reference has been made to disclosures of such apparatuses and methods which are incorporated herein by reference.

Figure 3:
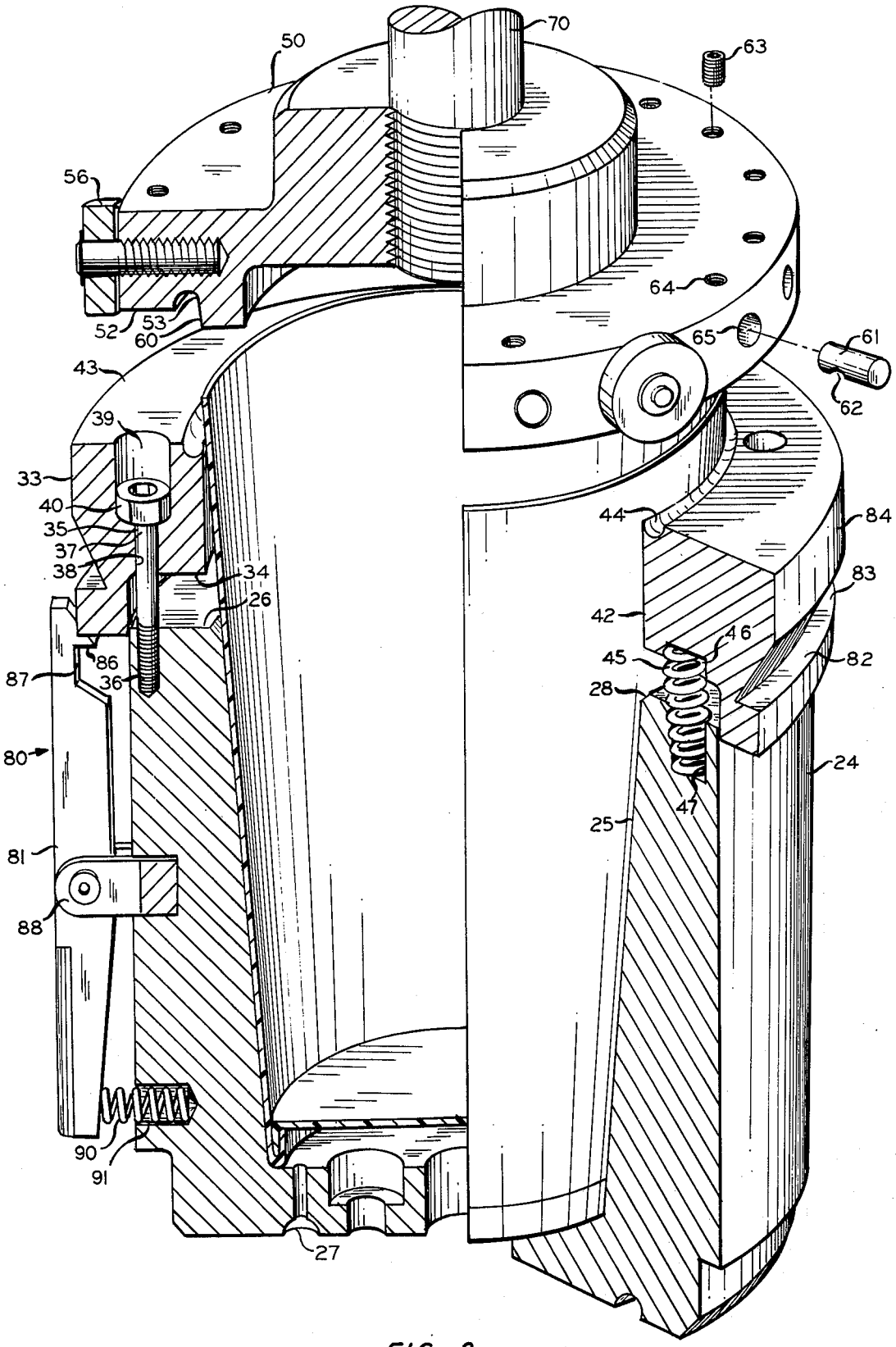
FIG. 3 is a perspective view of a container receiving receptacle with portions broken away to show structural details thereof with the forming head and ring being shown in a non-rim forming position.

The rim forming means 6 includes at least one container receiving receptacle 24 which has a container receiving pocket 25 therein with the receptacle having a free end surface 26 which are best shown by referring to FIG. 3. The pocket is sized and shaped to suitably receive therein a container blank 5 which while retained within the pocket 25 has the bead formed on the free end thereof. The end surface 26 forms a mating surface for a purpose to be later described. A tapered lead-in surface 28 extends between the mating surface 26 and the surface defining the pocket 25 and provides a lead-in to facilitate entry of a container blank 5 into the pocket 25.

In a preferred embodiment, the receptacle 24 is mounted on a conveying means, however, it is to be understood that means for conveying the receptacle are not necessary as a container blank 5 can be transported to a stationary receptacle in which the bead can be formed. However, it is preferred that the receptacle be movable by conveying means 30 so as to facilitate high speed production of containers. Any suitable type of conveying means can be used and as illustrated the conveying means 30 includes a rotatable turret 31 which is mounted on the support 10 and preferably has an axis of rotation parallel to the axis of rotation of the turret 15. Drive means (not shown) are operably associated with the turret 31 to effect rotation thereof preferably in a sequential manner whereby and as illustrated the turret 31 has a plurality of receptacles 24 mounted thereon whereby each receptacle can be moved to a desired position for different steps of the bead-forming operation. The drive means (not shown) are well known in the art and need not be further described herein and can include an indexing drive means such as an index unit made by Commercial Cams Co. of Chicago, Ill., a division of Emerson Electric Co. As best seen in FIG. 1, the turret 31 is rotatably mounted adjacent the turret 15 whereby a finished container blank 5 is ejected from a mandrel 16 after same is completed and into a waiting receptacle 24 such as by using air to eject the container blank 5. After receiving a container in the receptacle, the turret can then move one step at a time until the container blank is moved to the forming means after which the container having the rolled rim thereon can be ejected from the receptacle such as by the use of pressurized air introduced into the receptacle 24 through ports 27.

Forming means 6 is provided for the apparatus 1 to form the rolled rim or bead 7 on the end 8 of the container blank 5. The forming means 6 includes a ring member 33 suitably movably mounted on a respective receptacle 24 and having a surface 34 which is a mating surface with the surface 26. Any suitable mounting means can be provided and as shown guide members 35 are secured to one of the ring 33 or receptacle 24 and is movable in the other of the ring 33 or receptacle 24 so as to allow relative movement therebetween and provide guides to facilitate the movement. As shown, the guides are threaded bolt-type members which are threadably engaged in threaded bores 36 in the receptacle 24 and have bearing portions 37 slidably received through guide bores 38 through a portion of the ring 33. A counter sink 39 is coextensive with a respective bore 38 and provides a recess for a head portion of the guide 35 to be received therein wherein the head portion 40 also acts as a stop to limit movement of the ring 33.

Figure 4:
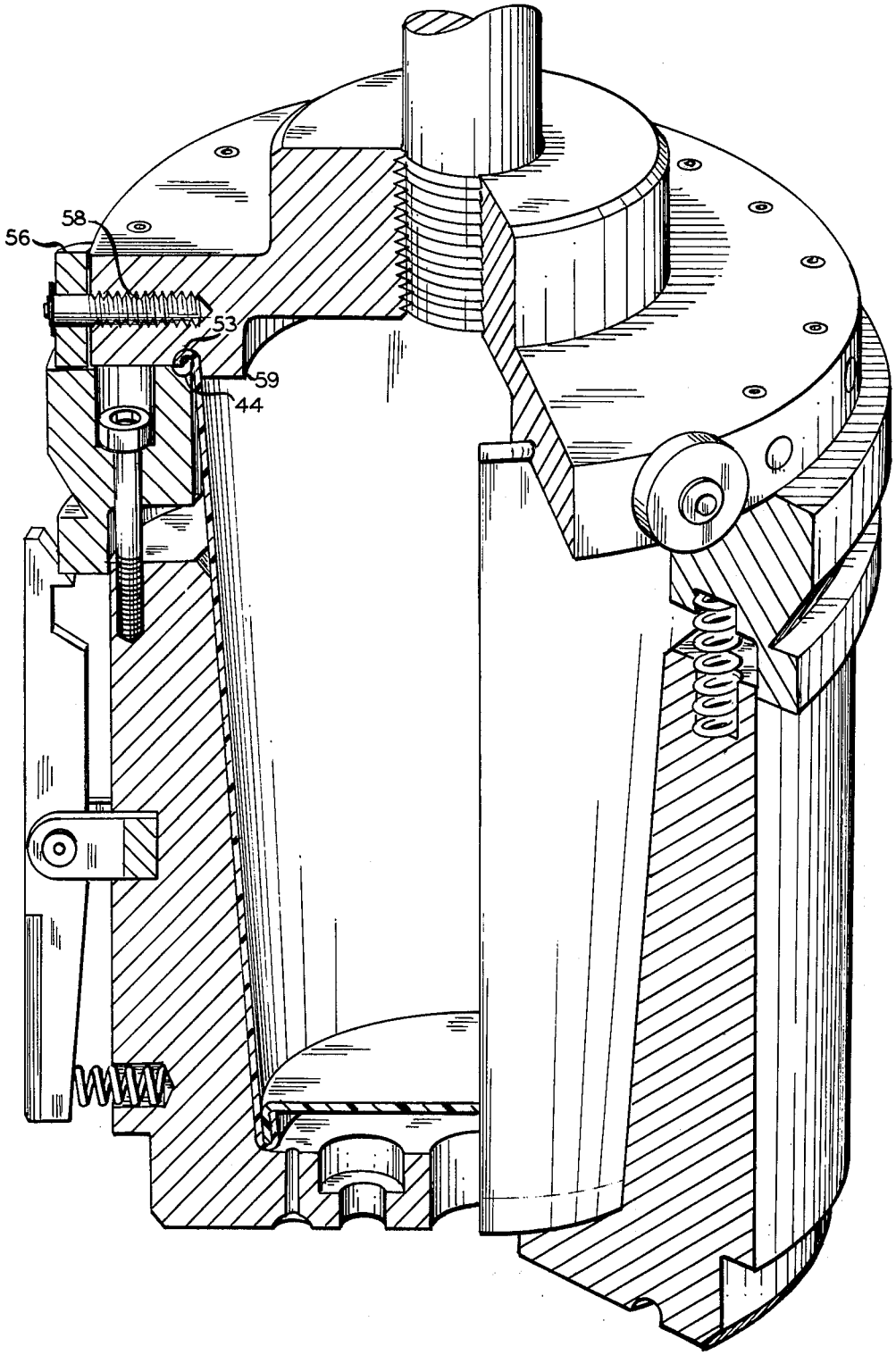
FIG. 4 is a view similar to FIG. 3 showing the forming head and ring cooperating to start the formation of the rolled rim.

The ring 33 has a through bore 42 which is coaxial with the axis of the pocket 25 with the bore 42 preferably having a size slightly larger than the size of the open end of the pocket 24 and preferably a size so as to form a continuous surface with the tapered surface 28 so as to form a smooth lead-in for the closed end of the container blank 5. This is best seen in FIG. 4. Also, the ring 33 has an upper surface 43 which is generally parallel to the surface 34 and faces away from the pocket 25. Positioned radially outwardly from the surface defining the bore 42 there is an annular groove portion 44 recessed within the surface 43 for forming the rim 7. Preferably, the surfaces 43 and 34 are generally normal to the axis of the bore 42 and axis of the pocket 25.

Figure 5:
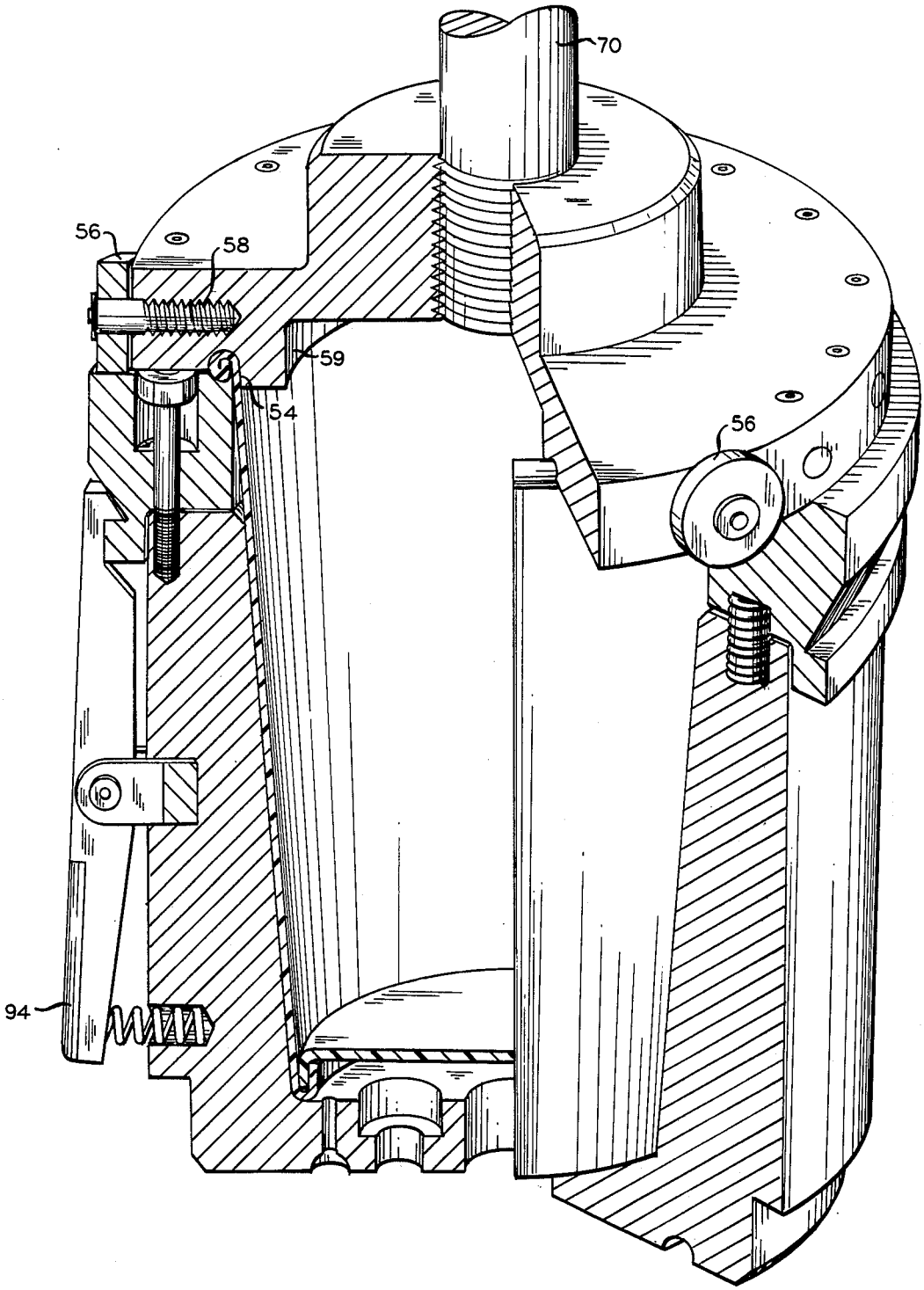
FIG. 5 is a view similar to FIGS. 2 and 3 showing the forming head and ring in a position which has completed the formation of the rolled rim.

The ring 33 is movable between an extended position as seen in FIG. 3 and a retracted position as best seen in FIG. 5 wherein the surfaces 34 and 26 are in engagement with one another to limit the movement of the ring 33. Preferably, the ring 33 is biased to its extended position by resilient means which in the illustrated structure include a plurality of resilient members 45 such as coil springs which are positioned between the ring 33 and the receptacle 24 and are preferably received within pockets 46 and 47 which are in the ring 33 and receptacle 24, respectively, and are recessed in the surfaces 34 and 26, respectively.

The forming means further includes a forming head 50 which is mounted on drive means 51, best shown in FIG. 1, to effect rotation of the forming head 50 and also movement of same between an extended and retracted position as more fully described hereinbelow. The forming head 50 has a surface 52 with a bead forming groove portion 53 recessed therein which cooperates with the groove portion 44 to form a substantially enclosed bead forming groove as best seen in FIGS. 4 and 5. By substantially enclosed, it is meant that there is an opening 54 which communicates with the groove portions 44 and 53 when the forming head is adjacent the ring 33 so as to allow the wall of the container blank 5 to enter the groove. As used herein, the extended position of the forming head 50 is that in which it is adjacent the ring 33. However, it is to be noted that the forming head is adjacent the ring 33 throughout the distance which the ring 33 moves from its extended position to its retracted position which is included in the extended position of the forming head 50. This can best be seen by referring to FIGS. 4 and 5. To reduce friction between the forming head 50 and the ring 33 during rotation of the forming head 50, bearing means is provided and in the illustrated structure the bearing means includes a plurality of rollers 56 which are rotatably mounted on the forming head as, for example, by being rotatably mounted on axles which are secured to the forming head in any suitable manner such as by threaded engagement as at 58. The rollers 56 are positioned such that they will engage the surface 43 before the surface 52 and 43 engage. An annular rib 59 projects from the surface 52 and is positioned radially inwardly from the groove 53 and is sized on its outer diameter to be received within the bore 42. The rib 59 has an outer surface 60 which is spaced from the surface defining the bore 42 a sufficient distance to allow the passage of the container wall therebetween so as to provide access to the groove formed by the groove portions 44 and 53. Preferably, the surface 60 is tapered or inclined away from the groove 53 and the surface defining the bore 42 so as to provide a lead-in for the wall of the container blank 5.

To reduce wear of the forming head 50, particularly in the groove 53, wear reducing members 61 are mounted in the forming head 50 with each of the members 61 having a notch 62 which corresponds in shape to the groove 53 and preferably is slightly above flush so that the container wall will contact the surface defining the notches 62 thereby reducing contact between the container blank 5 and the groove surface so as to reduce friction therebetween. This facilitates maintenance of the forming head 50 whereby inexpensive wear members 61 can be replaced instead of the entire forming head. The members 61 are held in position in any suitable manner as, for example, by having a set screw 63 in threaded engagement with the forming head 50 as in a threaded bore 64 which is in communication with a member receiving bore 65 whereby the set screw upon tightening will hold the member 61 in a removable manner within the respective bores 65. A plurality of the members 61 are positioned at various positions along the groove 53.

The drive means 51 can be of any suitable type and, as shown, has a shaft 70 which is rotatable by a power means such as an electric motor (shown in FIG. 1) and can be driven as, for example, by a belt 71 and pulley 72 arrangement. This provides rotational movement of the forming head 50. The shaft 70 is mounted in bearings 73 which provide not only for rotational movement but also axial movement of the shaft 70. The shaft 70 is suitably moved axially by means 74 which includes an arm 75 that moves a member 76 which is mounted on the shaft 70. The arm 75 is operably connected to means such as a shaft 77 receptacle rotated from the main drive of the machine to effect the movement of same and the member 76. Means for effecting rotational and axial movement of a shaft are well known in the art and it is to be understood that any suitable type of this means can be used.

Figure 7:
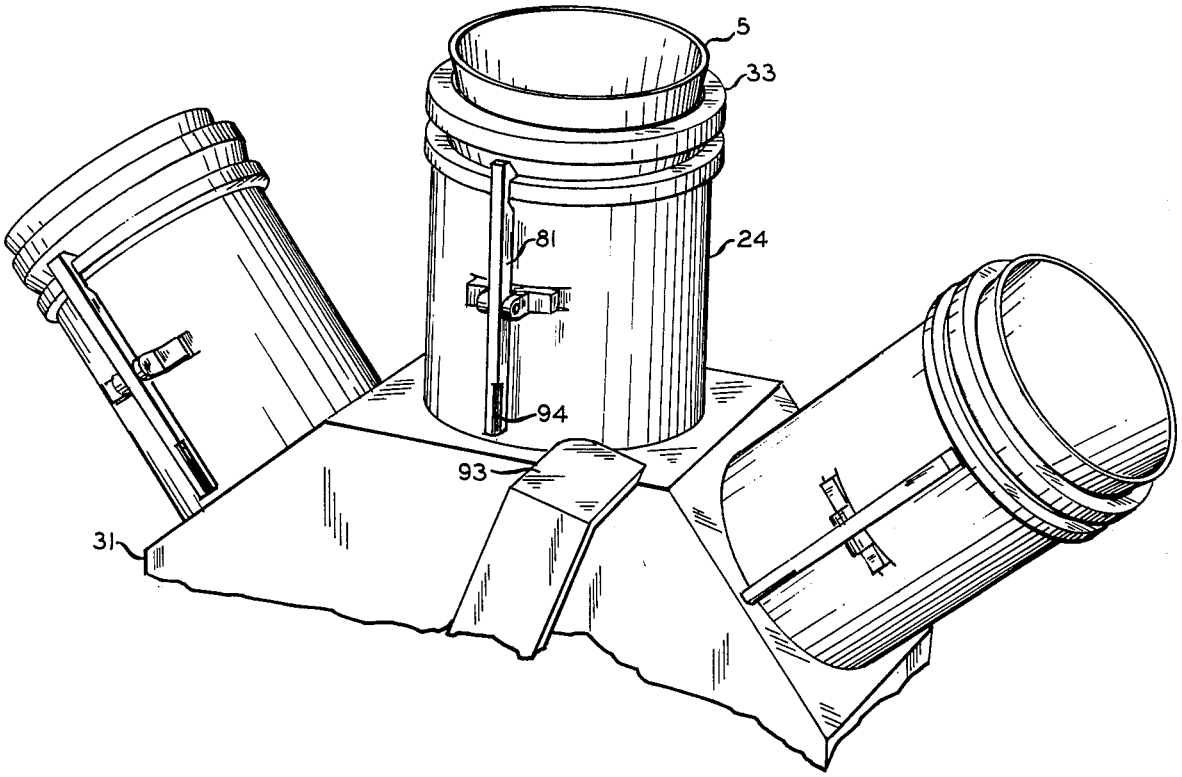
FIG. 7 is a fragmentary perspective view of latch and latch release means which cooperate with the ring.

Means 80 is provided to releasably retain the rings 33 in a retracted position. As shown, the means 80 is latch means with each of the receptacles having, in the illustrated structure, a latch member 81 mounted thereon which cooperates with a respective ring 33 to releasably retain same in the retracted position. As shown, each of the rings 33 has a suitable abutment 82 thereon and in the illustrated structure a groove 83 is in an exterior surface 84 of the respective ring 33 wherein the abutment 82 is a surface of the groove 83. The latch 81 has an abutment 86 which is formed by one of the surfaces defining a notch 87 in one end of the latch 81. The abutments 82 and 86 engage one another to releasably retain the ring in its retracted position. As shown, the latch 81 is pivotally mounted on the respective receptacle as, for example, by a pivot arrangement 88 which is suitably secured to the receptacle 24. Preferably, resilient means such as a spring 90 biases the latch 81 to its latching position as best seen in FIGS. 5. As shown, the spring 90 is received within a pocket 91 recessed in the receptacle 24. The spring then engages the latch 81 and by virtue of compression in the spring 90 biases the latch to its latching position. Referring to FIG. 7, means is provided to release the latch 81 from its latching position and, as shown, the means includes a trip cam member 93 which is secured to a portion of the apparatus 1 and is positioned adjacent to the turret 31 and during sequential movement of the turret 31, the respective latch 81 moves by the trip 93 and by virtue of same having an inclined surface 94 the latch 81 is induced to pivot as same moves by the trip 93 and thereby the latch 81 moves out of latching engagement with the ring 33. This release is just before the receptacle reaches the forming head 50. When unlatched, the ring 33 under the bias of the springs 45 moves to its extended position and is ready for forming a bead in cooperating with the forming head 50 and upon movement of the forming head 50 to its extended position, the ring 33 is thereby moved to its retracted position during formation of the bead 7 and the latch 81 reengages the ring 33 to retain same in its retracted position.

When the ring 33 is in its extended position the grooves 44 and 53 are complementary to aid the formation of a uniform smooth shaped bead 7 and in its retracted position, the ring 33 reduces the friction on the side of the container to permit its ejection as hereinafter described.

Figure 6:
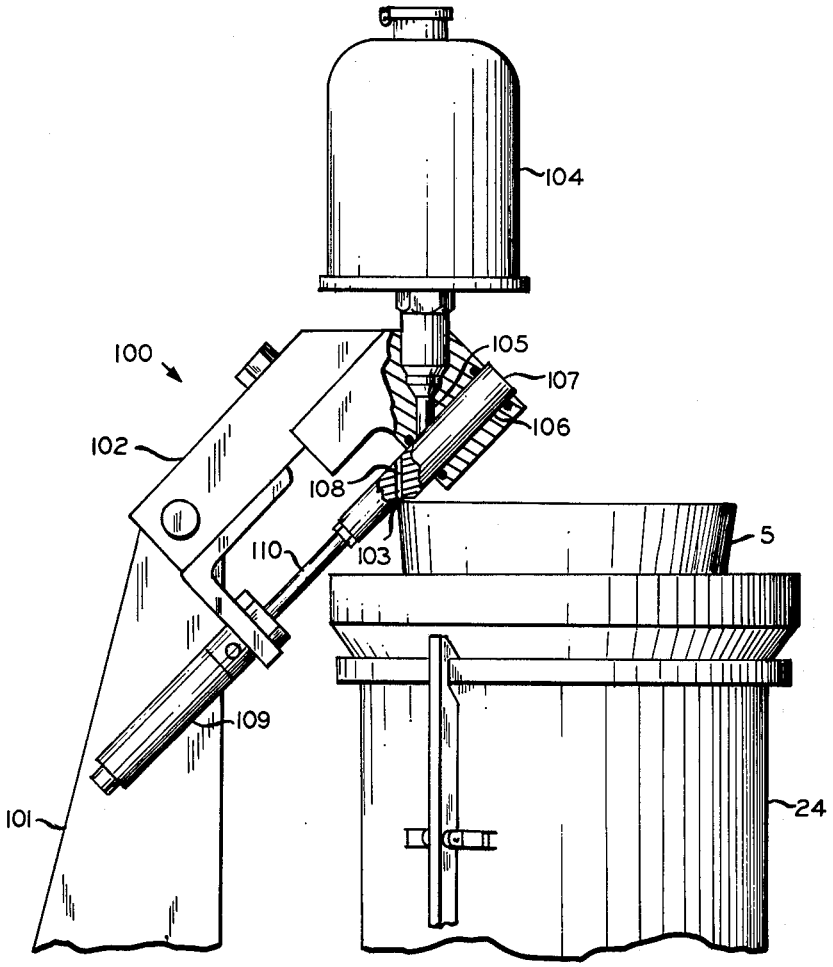
FIG. 6 is a fragmentary view of a container blank lubricator.

In a preferred embodiment, a lubricating means 100 as shown in FIG. 6, is provided and is operable to lubricate the upper edge of the container blank 5 before same has the bead formed thereon. This lubrication is desirable to facilitate formation of the bead 7. Such lubricators are known in the art and, as shown, the lubricator is positioned above the receptacle 24 at a location ahead of the forming head 50 so that in the dispensing position as shown, the outlet 103 touches the edge of the container blank 5. The lubrication means 100 is supported on the arm 101 attached to the frame of the machine, a bracket 102 has a reservoir 104 at its upper end with its outlet 105 communicating with the bore 106 of bracket 102, the bore 106 has a piston 107 therein attached to the piston rod 110 of pneumatic cylinder 109. Piston 107 has a throughbore 108 that in the extended position of piston 107 communicates with outlet 105 to receive lubricant from reservoir 104 and in the retracted position dispenses lubricant to the edge of container blank 5. The pneumatic cylinder 109 is activated by means not shown for each indexing movement of turret 31. Reservoir 104 can alternately be a conduit supplying lubricant from a remote source.

The present invention is more fully understood by a description thereof. First a bottom member is formed and fed from the bottom feed means 17 into a mandrel 16 before a side wall is placed on the mandrel as is best seen in FIG. 2. In the formation of a container the side wall 12 is fed by the side wall feeder 11 to the heater 14 and after an adequate amount of heating in which the heating is to effect bonding of the overlapped portions of the side wall. The heated side wall 12 is fed to a mandrel 16 and held in place by the arm 18. The side wall 12 on its mandrel 16 is then moved to the side wall wrapper 20 which wraps the side wall around the mandrel and overlaps portions thereof which are secured together as is known in the art. After the side wall 12 has been wrapped, the side wall and the bottom member carried by the mandrel are moved to a bottom heater 21 which heats the bottom and a portion of the side wall so that same can be secured together and after heating, same are moved to a bottom former 22 which bends a lower portion of the side wall inwardly and into contact with the depending skirt of the bottom member, after movement to a bottom crimper the bottom and side wall are pressed and held together for securement as is known in the art. The side wall blank 5 thus formed is moved to the position for ejectment from the respective mandrel 16 wherein same is ejected from the mandrel 16 into a respective receptacle 24. The receptacle 24 carries the container blank 5 to the bead forming means after same has passed the edge lubricator 100, if one is used, wherein the bead 7 is formed on the upper edge 8 of the container as described above. The container blank 5 is retained against rotation in the pocket 25 by friction engagement with the surface defining same. The finished container 2 is ejected as, for example, by introducing pressurized air through ports 27 in the bottom of the receptacle 24. The finished container 2 with its rolled rim 7 is ready for use.

It is to be understood that while we have illustrated and described certain forms of our invention, it is not to be limited to the specific form and arrangement of parts as herein described and shown.

What is claimed and desired to be secured by letters patent is:

1. An apparatus for forming a bead on a free open end of a container, said apparatus comprising:

(a) a container receiving receptacle having an open free end with a first surface defining the free end, said receptacle having a container receiving pocket therein extending inwardly from the open free end;

(b) a ring having a through bore communicating with said pocket, said ring also having second and third surfaces with said second surface being adjacent said first surface;

(c) first means movably mounting said ring on said receptacle wherein said ring is movable between an extended position away from said receptacle and a retracted position adjacent said receptacle with said first means also biasing said ring to the extended position, said ring having an annular first groove recessed in said third surface;

(d) latch means cooperating with said ring and operable to releasably retain said ring in its retracted position;

(e) second means cooperating with said latch means for selectively releasing same from retaining said ring in its retracted position;

(f) a forming head positioned adjacent to said ring and having a fourth surface with an annular second groove therein selectively cooperating with said first groove to form a substantially enclosed bead forming groove; and (g) third means with said forming head mounted on a portion thereof, said third means being operable for rotating said forming head and for selectively moving said forming head between an extended portion adjacent to and engaging said ring and a retracted position remote from said ring.

2. The apparatus as set forth in claim 1 including:

(a) a conveying means mounted on a support, said conveying means having a plurality of said receptacles and respective rings mounted thereon; and (b) drive means operably connected to said conveying means operable for effecting sequential movement thereof to selectively move a receptacle to a position adjacent to and in axial alignment with said forming head.

3. The apparatus as set forth in claim 1 wherein said first means includes:

(a) guide means cooperating with said ring and said receptacle for guiding movement of said ring wherein the axis of the through bore moves coaxially to the axes of said pocket, said guide means also preventing rotation of the ring about the axis of the bore;

(b) resilient means in cooperative engagement with said ring for biasing same to its said extended position; and (c) stop means cooperating with said ring for limiting movement thereof to the extended position.

4. The apparatus as set forth in claim 3 wherein:

(a) said guide means includes a plurality of guide rods secured to one of said ring and said receptacle and said guide rods are slidably received in guide bores in the other of said receptacle and ring;

(b) said resilient means includes a plurality of springs in engagement with both said receptacle and said ring; and (c) said stop means includes a shoulder on at least one of said guide rods and is engageable with a portion of one of the ring and receptacle, whichever has the guide bores therein.

5. The apparatus as set forth in claim 3 wherein:

(a) said first and second surfaces each have portions which are generally normal to the axis of the pocket and are substantially mating surfaces when said ring is in the retracted position.

6. The apparatus as set forth in claim 2 wherein said latch means includes:

(a) a latch member has an abutment portion engageable with a portion of said ring, with said latch member being selectively movable between retaining and release positions;

(b) fourth means cooperating with said latch member biasing same to the retaining position; and wherein (c) said second means includes a trip member selctively engageable with a portion of said latch member for moving same to the release position.

7. The apparatus as set forth in claim 6 wherein:

(a) said latch member is pivotally mounted on said receptacle and has a pawl forming the abutment portion;

(b) said fourth means includes a resilient member in engagement with a portion of said latch member; and (c) said ring portion engageable with said latch member abutment position is a shoulder on said ring.

8. The apparatus as set forth in claim 2 including:

(a) bearing means cooperating with said forming head and said ring for reducing friction therebetween during rotation of said forming head when same is in engagement with said ring; and (b) a guide rib depending from the fourth surface on said forming head and is positioned radially inwardly from said second groove and is sized to be received in said ring through bore with sufficient clearance therebetween for receiving a wall of a container between the rib and the surface defining said through bore.

9. The apparatus as set forth in claim 8 wherein:

(a) said bearing means includes a plurality of rollers rotatably mounted on said forming head and adapted to contact a portion of said ring when said forming head is in its extended position.

10. The apparatus as set forth in claim 8 including:

(a) a plurality of wear resistant first members mounted on said forming head, said first members each have a notch generally corresponding in shape to the shape of the second groove and are in substantial alignment therewith and are slightly above flush to the surface defining said second groove.

11. The apparatus as set forth in claim 2 wherein:

(a) said conveying means includes a turret rotatably mounted on a support with said drive means being operable to sequentially move each receptacle to a position adjacent the forming head.

12. The apparatus as set forth in claim 11 wherein:

(a) said receptacles extend from the turret radially outwardly from the axis of rotation of the turret.

13. An apparatus for forming a bead on a free end of a container, said apparatus comprising:

(a) a support;

(b) a turret rotatably mounted on said support;

(c) drive means operably connected to said turret for sequentially moving same;

(d) a plurality of container receiving receptacles mounted on said turret, said receptacles each having an open end and a first surface on said end, said receptacles each having a container receiving pocket therein;

(e) a ring movably mounted on each of said receptacles on the free end thereof and having a through bore extending between second and third surfaces and the bore in axial alignment with the respective pocket, said second surface is a mating surface with said first surface and said third surface has an annular groove therein around said through bore, said ring is movable between an extended position remote from the receptacle and a second position adjacent the receptacle;

(f) resilient means cooperating with said ring and biasing same to its extended position;

(g) latch means cooperating with said ring for selectively retaining same in the retracted position;

(h) a forming head positioned adjacent said turret, said head having a fourth surface adapted to be selectively positioned adjacent the third surface, said fourth surface having a second annular groove therein which cooperates with the first groove to form a substantially enclosed groove when the forming head and ring are adjacent one another, said forming head also having an annular rib positioned radially inwardly from said second groove and projects outwardly from said fourth surface, said rib being sized to be received in said bore and has sufficient clearance between same and the surface defining said bore to receive a container wall therebetween;

(i) power means operably associated with said forming head for effecting rotation and selective axial movement thereof between a retracted position remote from said ring and an extended forming position adjacent said ring; and (j) bearing means cooperating with said forming head and said ring when same are adjacent one another reducing friction therebetween during rotation of said forming head.

* * * * *